United States Patent [19]

Rossi

[11] 4,278,855

[45] Jul. 14, 1981

[54] SNAP ACTION SWITCH

[75] Inventor: Guglielmo Rossi, Linkenheim, Fed. Rep. of Germany

[73] Assignee: Ranco Incorporated, Columbus, Ohio

[21] Appl. No.: 129,715

[22] Filed: Mar. 12, 1980

[30] Foreign Application Priority Data

Mar. 13, 1979 [DE] Fed. Rep. of Germany ..... 8776/79

[51] Int. Cl.[3] ..... H01N 13/38

[52] U.S. Cl. ..... 200/67 D; 200/64 DA; 200/275

[58] Field of Search ..... 200/67 D, 67 R, 67 B, 200/67 C, 67 PK, 282, 275, 67 DA

[56] References Cited

U.S. PATENT DOCUMENTS

| | | | |
|---|---|---|---|
| 2,701,475 | 2/1955 | Readeker | 200/67 D |
| 2,805,297 | 9/1957 | Campbell | 200/67 D |
| 2,806,927 | 9/1957 | Allen | 200/67 D |
| 2,892,050 | 6/1959 | Fisher | 200/67 D |
| 3,539,742 | 11/1970 | Wilkes | 200/67 DA |
| 4,118,610 | 10/1978 | Purssell et al. | 200/67 DA |
| 4,145,587 | 3/1979 | Purssell | 200/67 D |
| 4,163,129 | 7/1979 | Rossi | 200/81.4 |

FOREIGN PATENT DOCUMENTS

| | | | |
|---|---|---|---|
| 247764 | 10/1963 | Australia | 200/67 D |
| 635 | 2/1979 | European Pat. Off. . | |
| 2329171 | 5/1977 | France . | |
| 977480 | 12/1964 | United Kingdom . | |

*Primary Examiner*—Willis Little

*Attorney, Agent, or Firm*—Watts, Hoffman, Fisher & Heinke Co.

[57] ABSTRACT

A snap action switch has a Q-shaped blade having two spring arms terminating in outwardly projecting parallel end portions which are located in a slot in a contact element, these end portions being drawn together upon insertion into the slot, and thereby stressing the blade for snap action. The end portions are retained in the slot by the reaction forces due to the stressing of the blade, and made good electrical contact with the contact element. The blade end portions may be drawn together by a clip to which a contact is rivetted.

The contact element may alternatively be carried by a conductive arm separate from the blade and operable by the latter.

12 Claims, 9 Drawing Figures

SNAP ACTION SWITCH

This invention relates to snap action switches.

A known type of snap action switch, described, for example, in U.S. Pat. No. 4,118,610 has a resilient blade formed with two cantilever arms which are interconnected at their free ends by a contact element welded to the two arms so as to draw the arms together and stress the blade for snap movement of the contact element relative to a fixed contact of the switch.

In order to fabricate such a snap action switch the contact element has to be welded to the cantilever arms while the latter are held in a stressed position. The welding of the contact element to the cantilever arms of such a switch blade necessitates a consistent quality of welding, resulting in a critical manufacturing operation. Moreover, since the contact can be welded to one side of the switch blade only, this technique is applicable to single-throw switches only.

An object of the present invention is to provide a snap action switch in which welding or other permanent fixing of the contact element of the switch blade is avoided, without adversely affecting the electrical characteristics of the switch. A further object of the invention is to provide a switch as aforesaid which can be employed as a changeover switch.

According to the invention there is provided a snap action switch including a resilient blade having two cantilever arms interconnected at their free ends by a contact element which stresses the blade for snap movement of the contact element, in which the contact element has an aperture or apertures in which the free ends of the arms are engaged and retained by virtue of the stressing of the arms of the blade.

It has been found that the contact element can be retained effectively on the arms of the switch blade solely through the stressing of the arms of the blade, which at the same time ensures good contact between the contact element and the switch blade.

In use of the switch the contact element cooperates with a fixed contact and preferably the play between the free ends of the arms and the or each aperture in the contact element is such as momentarily to cause an increase in the contact pressure between the contact element and the fixed contact immediately before separation of the contacts upon snap movement of the contact element.

Preferably the cantilever arms have end portions which extend substantially parallel to each other and engage opposite ends of a slot in the contact element. By suitably dimensioning the slot allowance can be made for angular movement of the end portions of the cantilever arms so that the contact element can effect a more or less linear displacement upon snap movement of the switch blade. Thus the slot in the contact element may taper in width from its centre towards its opposite ends, to allow angular movement of each blade end portion about the edge thereof which engages the respective end of the slot.

In a preferred embodiment of the invention the slot in the contact element is bounded by flat surfaces which converge towards opposite ends of the slot from the centre of the slot and which are engaged by the blade end portions in different positions of the contact element. The end portions of the switch blade may be formed at the free ends of respective limbs which project towards each other from the free ends of the cantilever arms.

The contact element preferably comprises an elongate body of conductive material formed with at least one elongate contact surface which is convex in transverse cross section. An elongate massive contact body is preferred for the purpose of dissipating by conduction heat generated in the contact element in use of the switch.

The contact element may be adapted to engage respective fixed contacts at opposite extreme positions of its snap movement, in which case the contact element may have respective elongate transversely convex surfaces on opposite longitudinal edge faces.

For some practical applications it may be expedient to provide an electrical contact on the switch blade which is separate from the means for stressing the blade. A snap action switch in accordance with this aspect of the invention comprises a resilient blade stressed for snap movement and having two cantilever arms interconnected at their free ends by a connecting element which engages laterally outer edges of the free ends of the blade arms, drawing the latter together and stressing the blade, and a contact member attached to or operatively connected to the free ends of the cantilever arms or to the connecting element. The contact member may be attached to the free ends of the cantilever arms by a rivet passing through the connecting element.

The movable electrical contact of the switch may alternatively be carried on an arm which is arranged to be moved by the resilient blade. Thus in another embodiment of the invention the connecting element has an aperture in which the free ends of the cantilever arms are freely engaged and an electrically conductive cantilever arm is engaged by the resilient blade and is moved upon snap movement of the latter to effect snap movement of a contact member carried by the said conductive arm. The connecting element may be attached to or formed integrally with the electrically conductive cantilever arm. Alternatively, the connecting element may engage the conductive cantilever arm without being secured to the latter.

The invention will be further described, by way of example, with reference to the accompanying purely diagrammatic drawings, in which.

The same reference numerals are used throughout the drawings to designate the same or corresponding components.

Figure 1:
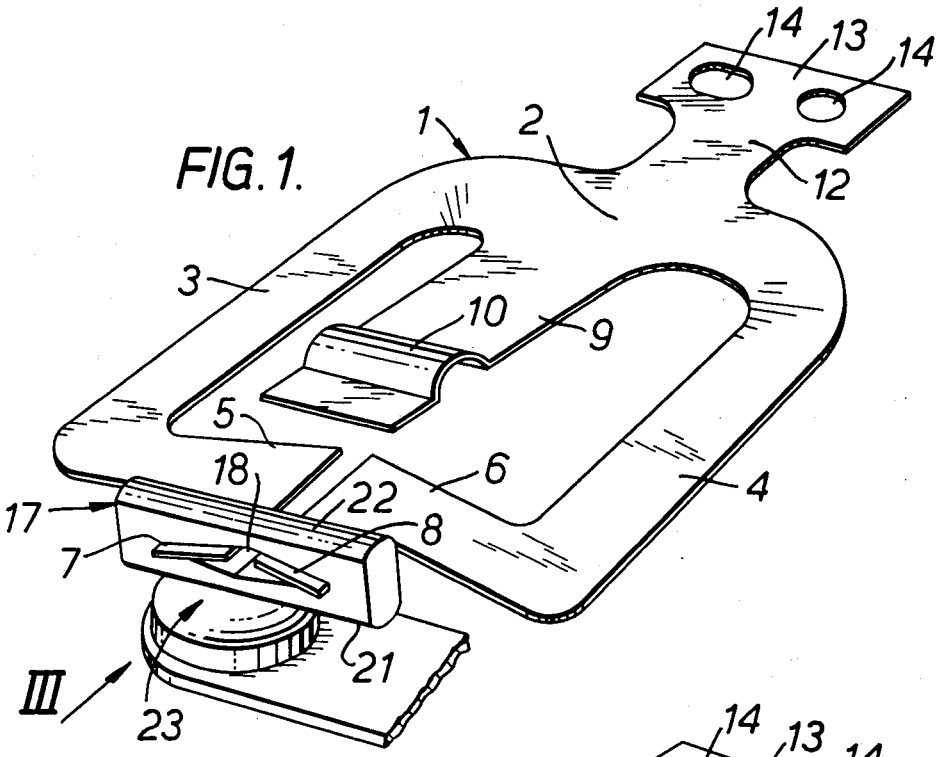
FIG. 1 is a perspective view illustrating components of a snap action switch according to a first embodiment of the invention, shown in a closed condition.
Figure 2:
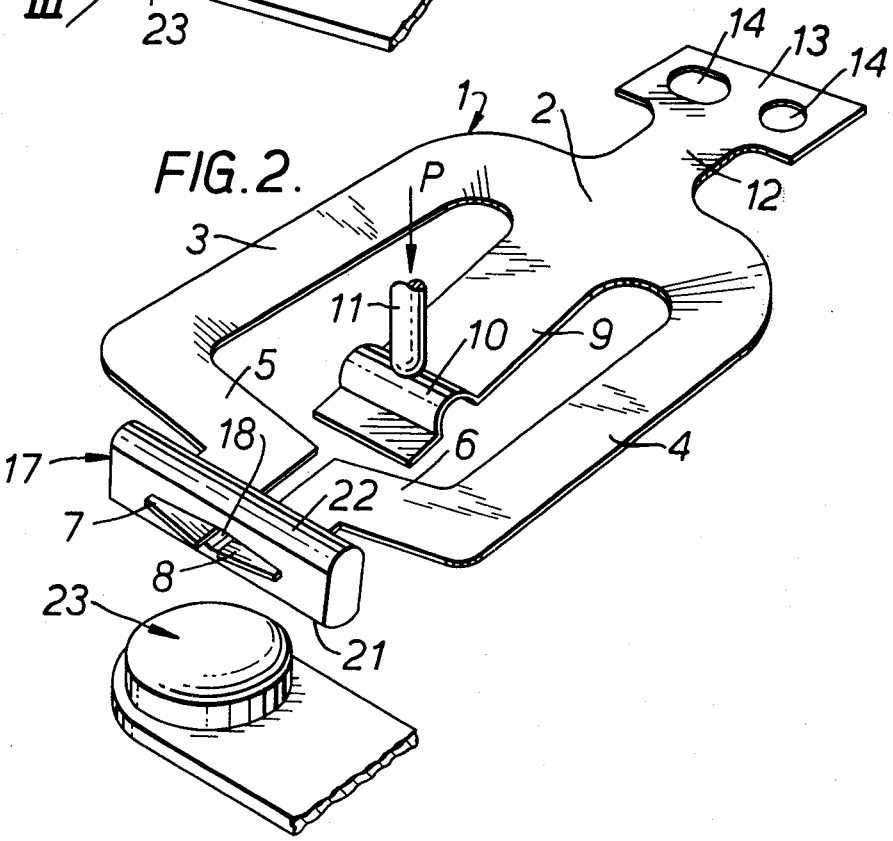
FIG. 2 is a perspective view of the switch components of FIG. 1, shown in an open condition.
Figure 3:
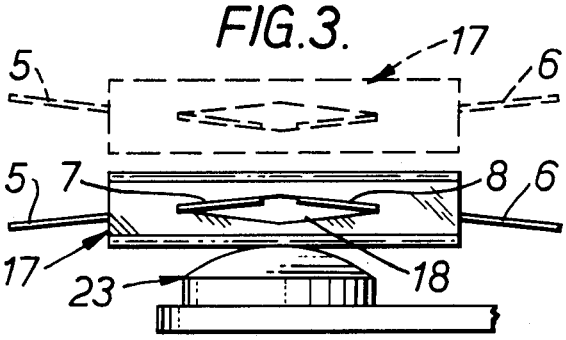
FIG. 3 is an end view in the direction of arrow III in FIG. 1.

Referring first to FIGS. 1 to 3, essential components of a snap action switch according to the invention are shown diagrammatically. The switch has a resilient Q-shaped blade 1 which is formed with a base portion 2 having two cantilever arms 3, 4 projecting therefrom in a direction substantially parallel to each other. At their free ends the cantilever arms are formed with respective limbs 5,6 which project towards each other and which in turn terminate in respective end portions 7,8 which are substantially perpendicular to the limbs 5, 6 and which project outwardly therefrom in substantially parallel directions.

The blade 1 is formed with an integral internal tongue 9 which is disposed symmetrically between the arms 3, 4 and which projects towards the limbs 5, 6. Near its free end the tongue 9 is formed with an arcuate raised portion 10 for engagement by a switch operating member 11 (FIG. 2).

The blade 1 further has an external tongue 12 projecting outwardly from the base portion 2 in the opposite direction to the inner tongue 9 and terminating in a flat mounting lug 13 which is formed with two fixing holes 14.

The switch blade 1 is designed to be attached to a fixed support (not shown), normally a conductive terminal strip, by means of rivets (not shown) passing through the fixing holes 14, so that the blade 1 projects cantilever fashion from the support. One of the fixing holes 14 is elongate in a transverse direction to allow slight accommodation of the position of the blade when mounting it on its fixed support.

Figure 4:
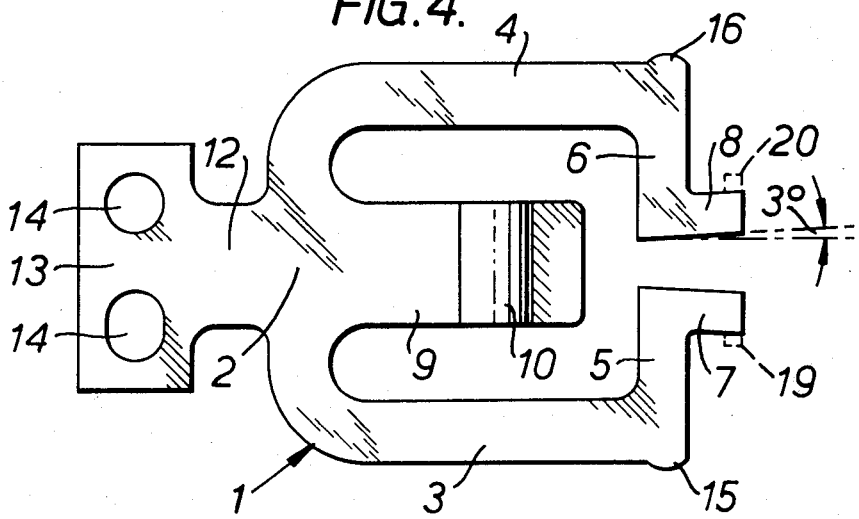
FIG. 4 is a plan view of a sheet metal blank used to form the switch blade of the switch shown in FIGS. 1 to 3.

The switch blade 1 is formed in a single pressing operation from an initially flat piece of resilient conductive sheet metal, for example beryllium-copper. The stamped sheet metal blade 1 is shown in plan in FIG. 4. The raised portion 10 of the inner tongue 9 may be formed simultaneously in the pressing operation in which the blade 1 is cut from a sheet metal blank. Reference to FIG. 4 will show that the two end portions 7,8 although substantially perpendicular to the respective limbs 5,6 are in fact inclined to the strictly perpendicular direction at an angle of about 3°, the end portions 7,8 diverging towards their free ends. This divergence allows for the subsequent prestressing of the blade for snap action, which will normally be done before the blade is anchored to its fixed support, but which may be carried out after the anchoring of the blade.

In order to effect the blade pre-stressing the outer corners 15,16 of the blade at the junctions of the arms 3,4 and the respective limbs 5,6 are subjected to inwardly directed forces by, for example, respective tools (not shown) which urge the two limbs 5,6 towards each other. The outer corners 15,16 of the blade may be suitably rounded to facilitate the engagement of the blade deforming tools therewith, as shown in FIG. 4. The inward deformation of the limbs 5,6 towards each other results in a dished deformation of the blade 1 as a whole, for example to the state illustrated in an exaggerated form in FIG. 1, while the two end portions 7,8 are brought close to each other so as to lie substantially parallel to each other, while remaining separated by a small clearance.

Having stressed the initially flat blade 1 by deformation as described, a contact element 17 is attached to the projecting end portions 7, 8. The contact element 17 comprises an elongate bar formed centrally with a slot 18 extending through its entire thickness, the length of the slot 18 being such as to accommodate the two blade end portions 7, 8 with the clearance between them, as shown in FIG. 1. The contact element 17 is simply placed over the end portions 7, 8 and the pressure applied to the opposite corners 15, 16 of the blade is then released, whereupon the end portions 7, 8 are urged outwardly by the prestressing of the blade into engagement with the opposite ends of the slot 18. The resilient engagement of the opposite edges of the end portions 7, 8 with the opposite ends of the slot 18 is sufficient to retain the contact element 17 on the blade by friction alone. To further assist in retaining the contact element 17, however, the end portions 7, 8 may be sufficiently long to project through the slot 18 beyond the contact element 17, the projecting ends of the portions 7, 8 being upset or deformed to prevent subsequent removal of the contact element 17. Alternatively, the end portions 7, 8 may be undercut, forming respective heels 19, 20, as shown in broken outline in FIG. 4, which project away from each other and which extend beyond the opposite ends of the slot 18 after the contact element has been fitted to the end portions 7, 8, to retain the contact element 17 positively upon the end portions.

The slot 18 in the contact element 17 tapers in width from its centre towards its opposite ends, the slot 18 being bounded by flat surfaces which converge towards the opposite ends of the slot from the centre of the slot and which are engaged by the flat end portions 7, 8 of the blade in different operative conditions of the latter, as described with reference to FIGS. 2 and 3.

The contact element 17 is formed on opposite longitudinal edges with respective contact surfaces 21, 22 which are convex in transverse cross section and which are adapted to engage respective fixed contacts in different operative positions of the blade. In the drawings, only one fixed contact, 23, is shown diagrammatically for the sake of simplicity. The fixed contact 23 has a convex contact surface which in one position of the blade (FIG. 1) makes electrical contact with the convex contact surface 21, midway between the ends of the latter.

The elongate contact element 17 can conveniently be fabricated from an extruded length of solid metal rod which may be extruded with the required cross sectional shape and then pierced at intervals to form through slots 18 before being cut to form the individual contact elements 17. Alternatively, the piercing and cutting of the extruded metal rod may be carried out in a single operation.

In the closed condition of the illustrated switch components the contact element 17 is held against the fixed contact 23 by a contact pressure derived from the resilience of the prestressed blade 1, which in this configuration has an upwardly convex dished shape such that the two arms 3, 4 are urged downwardly towards the fixed contact 23, and below the level of the inner tongue 9. The two limbs 5, 6 are inclined upwardly towards each other as viewed from the free end of the blade (FIG. 3) so that the end portions 7, 8 lie in contact with the upper flat surfaces of the slot 18 in the contact element 17. The contact pressure with which the contact element 17 is urged against the fixed contact 23 derives from the fact that in this position the switch blade is urged by its prestressing towards a stable position in which the contact element 17 would be carried beyond the fixed contact 23. In the illustrated configuration, therefore, the switch is a normally-closed switch in which the contact element 17 is held in contact with the fixed contact 23 by virtue of the prestressing of the blade 1.

When a force P is applied to the inner tongue 9 of the switch blade, in a downward direction as illustrated in FIGS. 1 and 2, by the switch operating member 11 engaging the raised portion 10, the tongue 9 is deflected so as to induce a snap-change in the dished configuration of the blade from the upwardly convex configuration of FIG. 1 to the upwardly concave configuration illustrated diagrammatically in FIG. 2. This snap-change is accompanied by a snap-movement of the two arms 3, 4 upwards relative to the fixed contact 23, so that the contact element 17 is lifted rapidly away from the fixed contact 23 into the open position of the switch (FIG. 2).

If the switch blade 1 is configured for monostable operation it will normally occupy the position shown in FIG. 1, but can be maintained in the position shown in FIG. 2 as long as the force P is applied to the tongue 9. The force P may, for example, be derived from a bellows or other temperature or pressure responsive actuator means.

In the position shown in FIG. 2, in which the contact surface 21 is separated from the fixed contact 23, the other contact surface 22 of the contact element 17 may come into contact with another fixed contact (not shown), adapting the switch for use as a changeover switch.

When the switch blade is in the upwardly concave dished configuration shown in FIG. 2 the two limbs 5, 6 of the blade, as viewed from the free end of the blade, are inclined downwardly towards the fixed contact 23, so that the end portions 7, 8 are in contact with the lower flat surfaces defining the slot 18, as shown in broken outline in FIG. 3. It will be noted that when the blade undergoes the snap transition from the configuration shown in FIG. 1 to that shown in FIG. 2 the end portions 7, 8 of the blade rotate about their outer edges, which remain in firm contact with the opposite ends of the slot 18. In undergoing this transition the end portions 7, 8 pass through a highly unstable position in which they are coplanar and spaced from the opposite bounding surfaces of the slot 18. The end portions 7, 8 therefore move rapidly from this unstable position and strike the lower surfaces of the slot 18, before the contact member 17 leaves the fixed contact 23. This results in a momentary increase in the contact pressure between the contact element 17 and the contact 23 immediately before the contacts open. Such a pre-snapping contact pressure is beneficial to the switching action and increases the speed with which the contacts eventually separate.

The contact element 17 is made from solid metal, preferably silver, and, being massive, acts as an effective heat sink for dissipating heat generated in the breaking of the contacts. Although the contact element 17 may be made in solid silver, a composite construction may alternatively be employed in which a massive contact element of, for example, brass provided with a silver or other conductive coating. Where the contact element 17 is intended to make and break a single contact only it may have a laminated construction with a silver contact strip applied to a brass or other thermally conductive backing member.

The construction of the switch according to the invention avoids the need for welding of a contact to the free ends of the cantilever arms 3, 4 of the switch blade 1. Furthermore, the "pivotal" connection between the projecting ends 7, 8 of the blade arms and the contact element 17 affords, in effect, a floating connection between the contact element 17 and the switch blade, the stress loading of the projecting portions 7, 8 ensuring good electrical contact between the switch blade and the contact element 17.

To avoid any frictional rubbing between the contact element 17 and the switch blade a clearance gap should always exist between the contact element 17 and the outlet edges of the limbs 5,6 of the switch blade. As stated earlier, positive retention of the contact element 17 on the projecting end portions 7, 8 may be ensured by under-cutting the laterally outer edges of the end portions 7, 8 about which these portions "pivot" within the slot 18.

Figure 5:
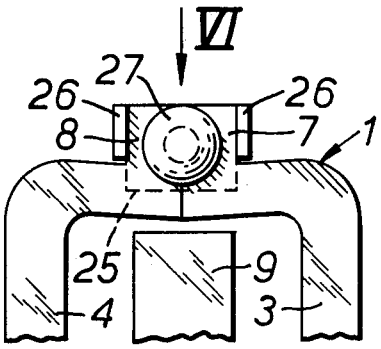
FIG. 5 is a partial plan view of a switch blade according to a second embodiment of the invention.
Figure 6:
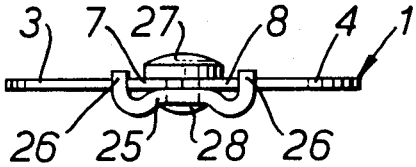
FIG. 6 is an end view in the direction of arrow VI in FIG. 5.

A construction according to a second embodiment of the invention which also avoids the necessity of welding a contact to the switch blade is illustrated diagrammatically in FIGS. 5 and 6. In this alternative, the end portions 7, 8 are drawn together to prestress the switch blade by a connecting element 25 having upstanding end flanges 26 which embrace the laterally outer edges of the blade arm end portions 7,8. The connecting element 25 need not necessarily be a good electrical conductor and may, for example, comprise a steel brace or clip. A separate contact member 27 is attached to the free end of the blade by an integral rivet 28, the contact member 27 making good electrical contact with the flat end portions 7,8 of the blade, and the shank of the rivet 28 passing through the connecting element 25.

The contact member 27 may be of bi-metal construction comprising a body of copper or other suitable conductive material and a contact head of silver or silver alloy. Alternatively, the entire contact member 27 may comprise solid silver or silver alloy, affording two contact surfaces where the switch is intended for use as a changeover switch, with a shank of the same material making good electrical contact with the switch blade itself.

Figure 7:
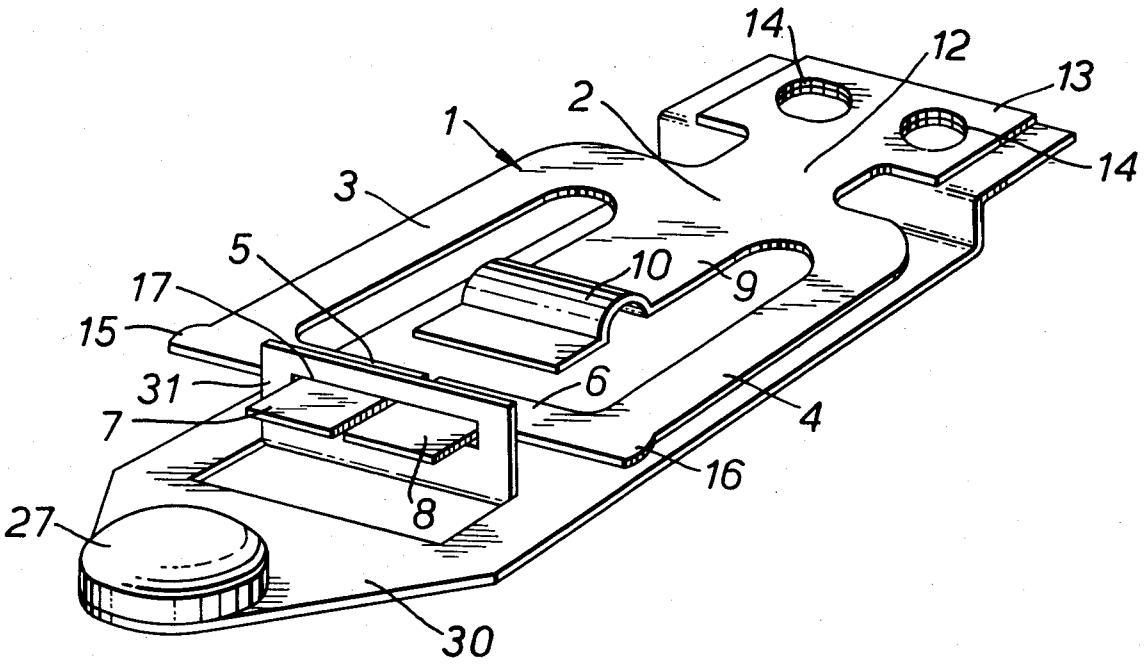
FIG. 7 is a perspective view of components of a snap action switch according to a third embodiment of the invention.
Figure 8:
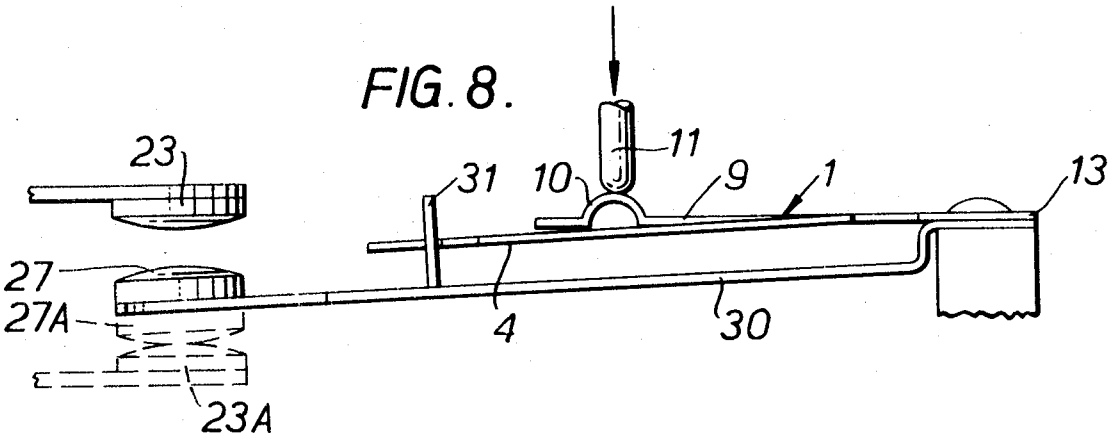
FIG. 8 is a side elevational view of the switch of FIG. 7, shown in an open condition.
Figure 9:
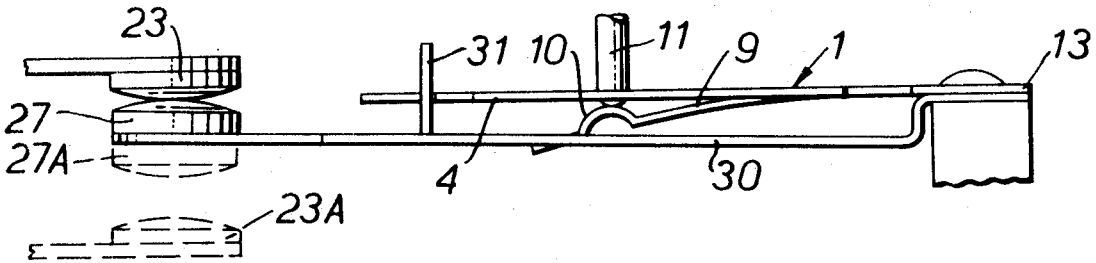
FIG. 9 is a side elevational view of the switch of FIG. 7, shown in a closed condition.

In the third illustrated embodiment of the invention the switch blade 1 does not itself carry a switch contact, but operates a contact-carrying arm. Referring to FIGS. 7 to 9 a cantilever arm 30 of electrically conductive material for example, beryllium copper, is anchored to a fixed support by the same rivets which fix the blade 1 to the support. The cantilever arm 30 has an upstanding tongue 31 near its free end, formed by upsetting from the arm 30, the tongue 31 acting as a connecting element and having a transverse slot 18 in which the end portions 7,8 of the blade 1 are engaged. At its free end the arm 30 carries a switch contact 27 attached to the arm by welding or rivetting.

By inward deformation of the limbs 5,6 towards each other, as described previously, a dished deformation is imparted to the blade 1. The two end portions 7,8 are brought close to each other so as to lie substantially parallel to each other while remaining separated by a small clearance. The end portions 7,8 of the stressed blade 1 are introduced into the slot 18 in the tongue 31 attached to the cantilever conductive arm 30. After the introduction of the end portions 7,8 into the slot 18 the pressure applied to the outer corners 15,16 of the blade 1 is then released, whereupon the end portions 7,8 are urged outwardly by the resilience of the stressed blade, bringing the laterally outer edges of the portions 7, 8 into engagement with the opposite ends of the slot 18. The resilient engagement of the opposite edges of the end portions 7,8 with the opposite ends of the slot 18 is sufficient to retain the end portions 7,8 in engagement with the tongue 31.

The flat mounting lug 13 of the blade is then anchored to the fixed support along with the adjacent end of the conductive arm 15 by rivets passing through the holes 14.

The slot 18 in the tongue 31 may taper in width from its centre towards its opposite ends, similarly to the slot 18 in the embodiment of FIGS. 1 to 3.

The contact 27 co-operates with a fixed contct 23. The switch shown in FIGS. 7 to 9 is a normally open switch in which the contacts 27,23, are separated in the normal condition of the switch, as illustrated in FIGS. 7 and 8. In this condition the prestressed blade 1 has an upwardly convex dished shape such that the two arms 3,4 are urged downwardly, below the level of the inner tongue 9. The two limbs 5,6 are inclined upwardly towards each other as viewed from the free end of the blade so that the end portions 7,8 lie in contact with the upper surfaces of the slot 18 in the tongue 31.

When a force is applied to the inner tongue 9 of the switch blade, in a downward direction as illustrated in FIG. 8, by the switch operating member 11 engaging the raised portion 10, the tongue 9 is deflected so as to induce a snap-change in the dished configuration of the blade 1 from the upwardly convex configuration of FIG. 8 to an upwardly concave configuration illustrated diagrammatically in FIG. 9. This snap-change is accompanied by a snap-movement of the two arms 3,4 upwards so that the arm 30 and the contact 27 carried thereby is lifted into engagement with the fixed contact 23 into the closed position of the switch (FIG. 9).

The pressure with which the contact 27 is urged against the fixed contact 23 in the closed position derives from the prestressing of the blade 1, which is urged towards a stable position in which the contact 27 would be carried beyond the fixed contact 23. If the switch blade 1 is configured for monostable operation it will normally occupy the position shown in FIG. 8, but can be maintained in the position shown in FIG. 9 as long as an operating force is applied by the operating member 11. The force may, for example, be derived from a bellows or other temperature or pressure-responsive actuator means.

If the switch is to be used as a changeover switch a further contact 27A may be provided on the opposite face of the cantilever arm 30 from the contact 27 (FIGS. 8 and 9), the contact 27A coming into contact with another fixed contact 23A when the contacts 27, 23 are separated. The contacts 27A,23A are shown in broken outline in FIGS. 8 and 9.

When the switch blade is in the upwardly concave dished configuration (FIG. 9) the two limbs 5,6 of the blade, as viewed from the free end of the blade, are inclined downwardly towards the fixed contact 23A, so that the end portions 7,8 are in contact with the lower surfaces defining the slot 18. In undergoing a snap movement the end portions 7,8 pass through a highly unstable position in which they are coplanar.

I claim:

1. A snap action swith including a resilient blade having two cantilever arms with respective end portions and a contact element interconnecting the end portions of said arms and stressing the blade for snap movement of the contact element, wherein the contact element has at least an aperture in which both said end portions are engaged, the contact element being retained on said end portions by virtue of the stressing of the arms of the blade, said contact element aperture tapering in width from its center towards its opposite ends, allowing angular movement of each blade end portion about the edge thereof which engages the respective end of the aperture.

2. The switch defined in claim 1, wherein the aperture in the contact element comprises a slot bounded by flat surfaces which converge towards opposite ends of the slot from the center of the slot and which are engaged by said blade end portions in different stable positions of the arms.

3. A snap action switch comprising a resilient blade having two cantilever arms formed with respective limbs which project towards each other from the free ends of said arms, respective end portions formed at the free ends of said limbs and extending substantially parallel to each other, and a contact element, spaced from said limbs by a clearance gap, interconnecting the end portions of said arms and stressing the blade for snap movement of the contact element, wherein the contact element has an aperture and said end portions engage respective opposite ends of the aperture, the contact element being retained on said end portions by virtue of the stressing of the arms of the blade.

4. A snap action switch comprising:

a resilient blade stressed for snap movement and having two cantilever arms, a connecting element interconnecting the free ends of said arms, said connecting element having an aperture in which said free ends of said cantilever arms extend and engaging laterally outer edges of said free ends of the blade arms and drawing the latter together to stress the blade, a contact member attached to or operatively connected to the connecting element, and an electrically conductive cantilever arm engaged by the resilient blade and carrying said contact member, said cantilever arm being movable upon snap movement of the resilient blade to effect snap movement of said contact member;

the resilient blade and the conductive cantilever arm being anchored at one end to a common support.

5. The snap action switch defined in claim 4, wherein the connecting element is attached to the electrically conductive cantilever arm.

6. A snap action switch defined in claim 4, wherein the connecting element abuts the conductive cantilever arm.

7. The snap action switch defined in claim 4, wherein the blade is of resilient sheet metal and the conductive cantilever arm is of electrically conductive resilient sheet metal.

8. A snap action switch comprising a resilient blade which snap moves between first and second operative positions having two laterally spaced cantilever arms defining respective projecting end portions and a contact element interconnecting the end portions, said projecting end portions extending into said contact element with an edge of each said projecting end portion in resilient bearing engagement with said contact element, said blade being stressed and dished by the bearing engagement between said end portions and said contact element, said blade being concavely dished when in said first operative position and convexly dished when in said second operative position, said end portions each being movable angularly about the location of bearing engagement with said contact element so that said end portions are concavely and convexly dished with said blade when said switch is in said first and second operative positions, respectively.

9. The switch defined in claim 8 or claim 21, further including a fixed contact with which the contact element cooperates, and wherein the play between the end portions of the arms and said contact element enables a momentary increase in the contact pressure between the contact element and the fixed contact immediately before snap-separation of the contacts.

10. The switch defined in claim 8, wherein the contact element defines a slot with the width of the slot being such that the two end portions can be inserted in the slot and engage opposite ends of the slot.

11. A snap action switch comprising:

a resilient blade having two cantilever arms, said blade further comprising limbs which project towards each other from respective ends of the arms, said limbs having respective end portions which extend substantially parallel to each other and transverse to the directions of extent of their respective associated limbs, a connecting element interconnecting said end portions, said connecting element engaging laterally outer ends of said end portions and drawing the latter together to stress the blade, and a contact member attached to the connecting element.

12. The snap action switch defined in claim 11 wherein the contact member is attached to the connecting element by a rivet passing through the connecting element and through the adjoining end portions.

* * * * *